US007118514B2

(12) United States Patent
Underbrink et al.

(10) Patent No.: US 7,118,514 B2
(45) Date of Patent: Oct. 10, 2006

(54) PLAYGROUND EQUIPMENT

(75) Inventors: John Underbrink, Richardson, TX (US); Joshua Rothacker, Rochester, WA (US); Brian Lovgren, Shelton, WA (US)

(73) Assignee: BigToys, Inc., Olympia, WA (US)

( * ) Notice: Subject to any disclaimer, the term of this patent is extended or adjusted under 35 U.S.C. 154(b) by 148 days.

(21) Appl. No.: 10/980,774

(22) Filed: Nov. 2, 2004

(65) Prior Publication Data

US 2006/0094568 A1 May 4, 2006

(51) Int. Cl.
*A63G 11/00* (2006.01)
*A63B 21/00* (2006.01)

(52) U.S. Cl. ..... 482/35; 472/106; 472/114

(58) Field of Classification Search ..... 472/1, 472/4, 5, 102, 106–115; 482/23–37; 104/75; 280/1, 1.192, 222; 297/247; 446/322
See application file for complete search history.

(56) References Cited

U.S. PATENT DOCUMENTS 1,695,737 A * 12/1928 Molsdale ..... 297/247
1,898,466 A 2/1933 Pierson
3,070,035 A 12/1962 Russo et al.
3,168,310 A 2/1965 Strausser
3,261,605 A * 7/1966 Smith ..... 472/114
4,135,712 A * 1/1979 Fitzsimons ..... 472/113
5,443,012 A 8/1995 Underbrink et al.
5,468,199 A 11/1995 Keeler et al.
5,816,167 A 10/1998 Danforth et al.
5,904,099 A 5/1999 Danneker
5,931,100 A 8/1999 Sutton et al.
5,984,058 A 11/1999 Danneker
6,044,766 A 4/2000 Underbrink et al.

* cited by examiner

*Primary Examiner*—Glenn E. Richman
(74) *Attorney, Agent, or Firm*—Christensen O'Connor Johnson Kindness PLLC

(57) ABSTRACT

A playground device, in the nature of a teeter-totter, includes first and second spaced base members. An arcuate rail is coupled to the base members in an upright arc. An arcuate member surrounds at least a portion of the rail and is mounted for to-and-fro movement relative to the rail. User platforms or other user-friendly features are mounted on the tube. A biasing mechanism coacts between the member and the rail to bias the member toward a predetermined preferably central position on the rail, while allowing the tube to move to-and-fro on the rail.

9 Claims, 8 Drawing Sheets

PLAYGROUND EQUIPMENT

FIELD OF THE INVENTION

The present invention relates to novel playground equipment, and more particularly, to an apparatus that can be used by one or more people and the function of which is somewhat comparable to the conventional teeter-totter.

BACKGROUND OF THE INVENTION

A conventional teeter-totter has been used on playgrounds for many years. Recently, there has been concern about the safety of the teeter-totter and thus, its use has decreased significantly. There has, therefore, been for some time, a need for a safe substitute for the conventional teeter-totter.

SUMMARY OF THE INVENTION

The present invention therefore provides a playground device comprising first and second base members. An arcuate rail is coupled to the base members. An arcuate member, preferably a hollow tube, surrounds at least a portion of the rail and is mounted for to-and-fro movement relative to the arcuate rail. User platforms may be mounted at each end of the member. Finally, a biasing means coacts between the member and the rail to bias the member toward a predetermined, preferably central, position on the rail, while allowing the member to move to-and-fro on the rail. Preferably, the arcuate rail and hollow tube are segments of a circle. The rail is mounted in an upright position so as to extend first in an upwardly extending arc, and then in a downwardly extending arc. The rail thus has an uppermost, central portion that coincides with the preferred central position toward which the biasing means urges the tube.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
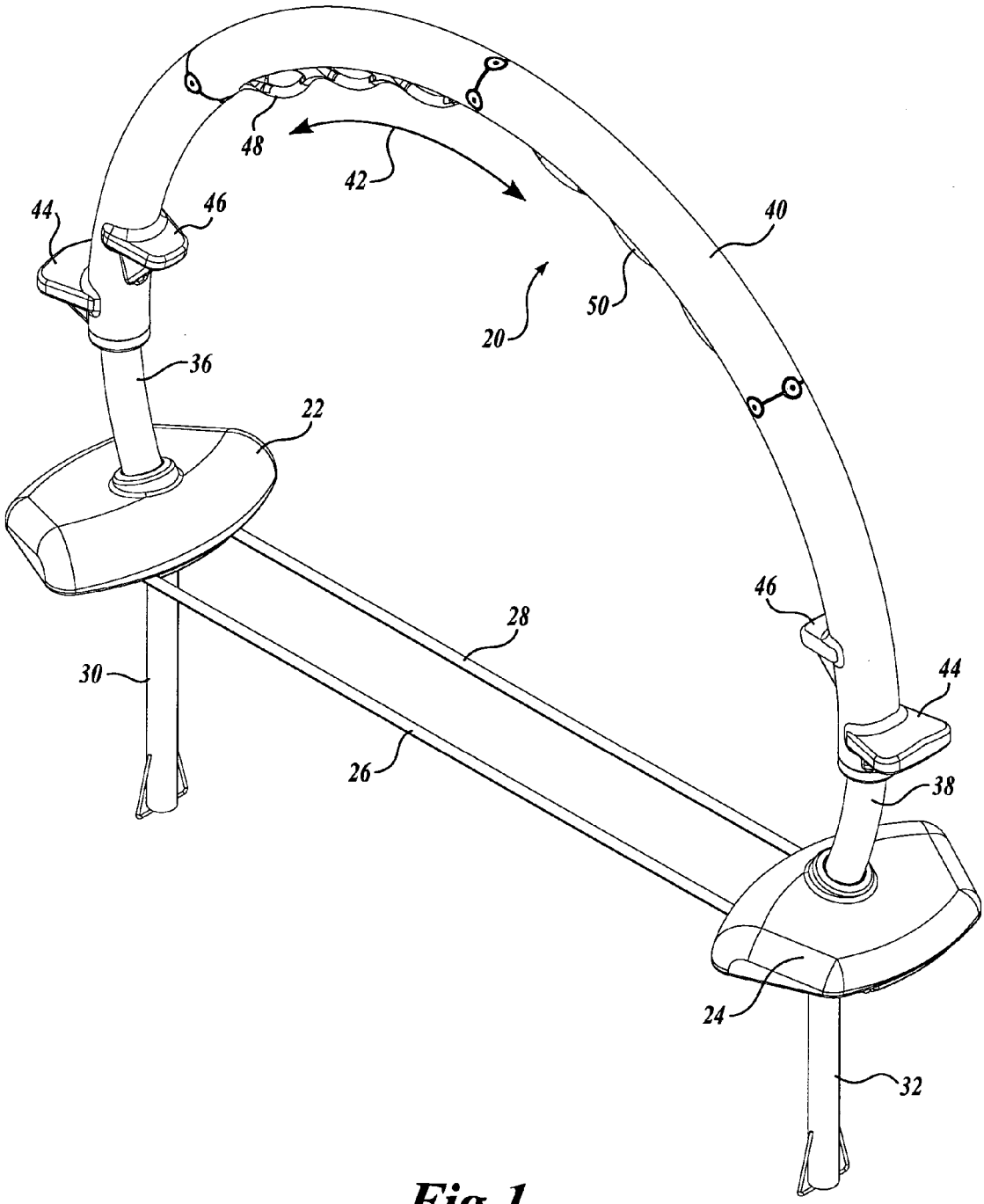
FIG. 1 is an isometric view of the playground device of the present invention viewed from the upper right.
Figure 2:
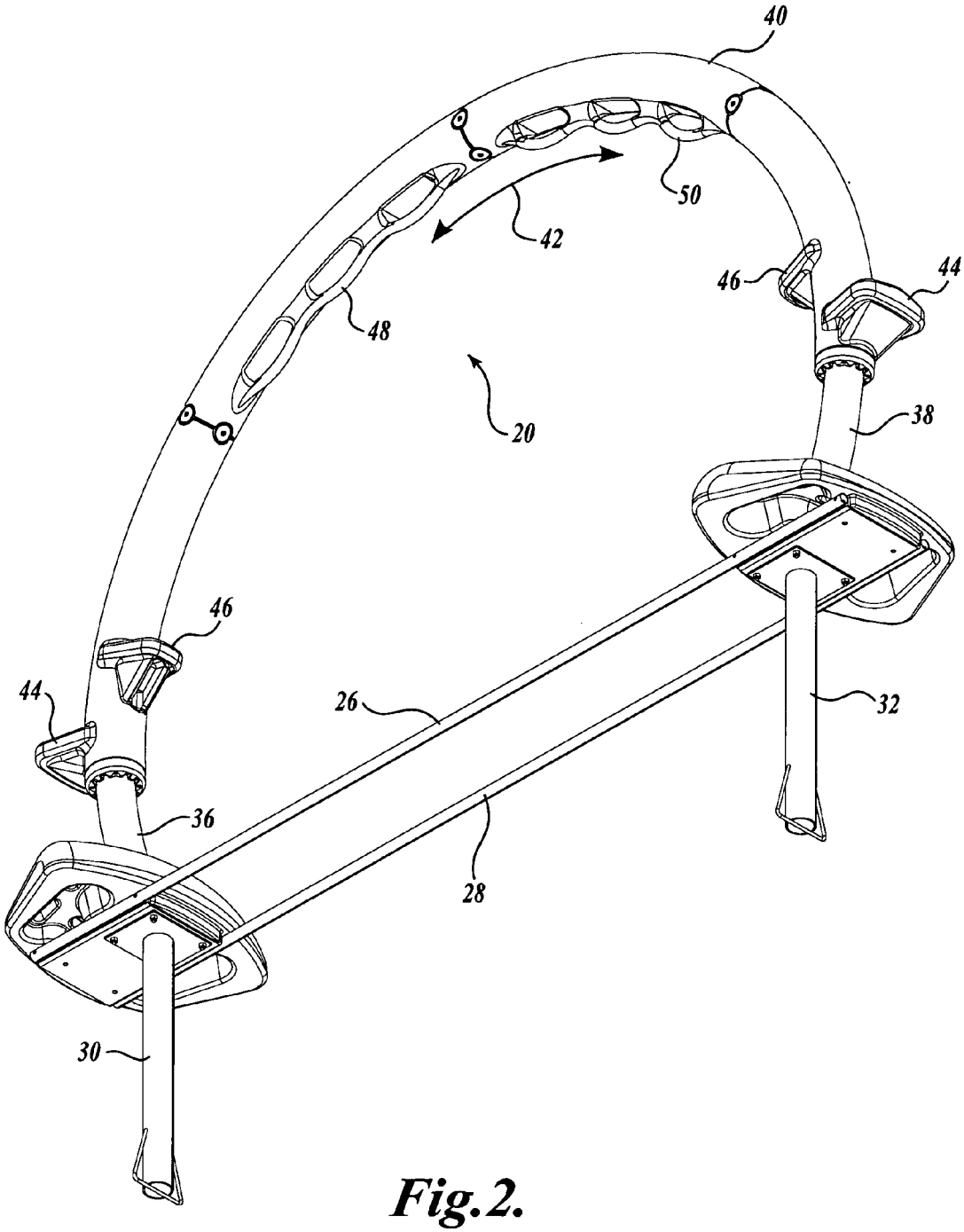
FIG. 2 is an isometric view of the playground device viewed from the lower right.
Figure 3:
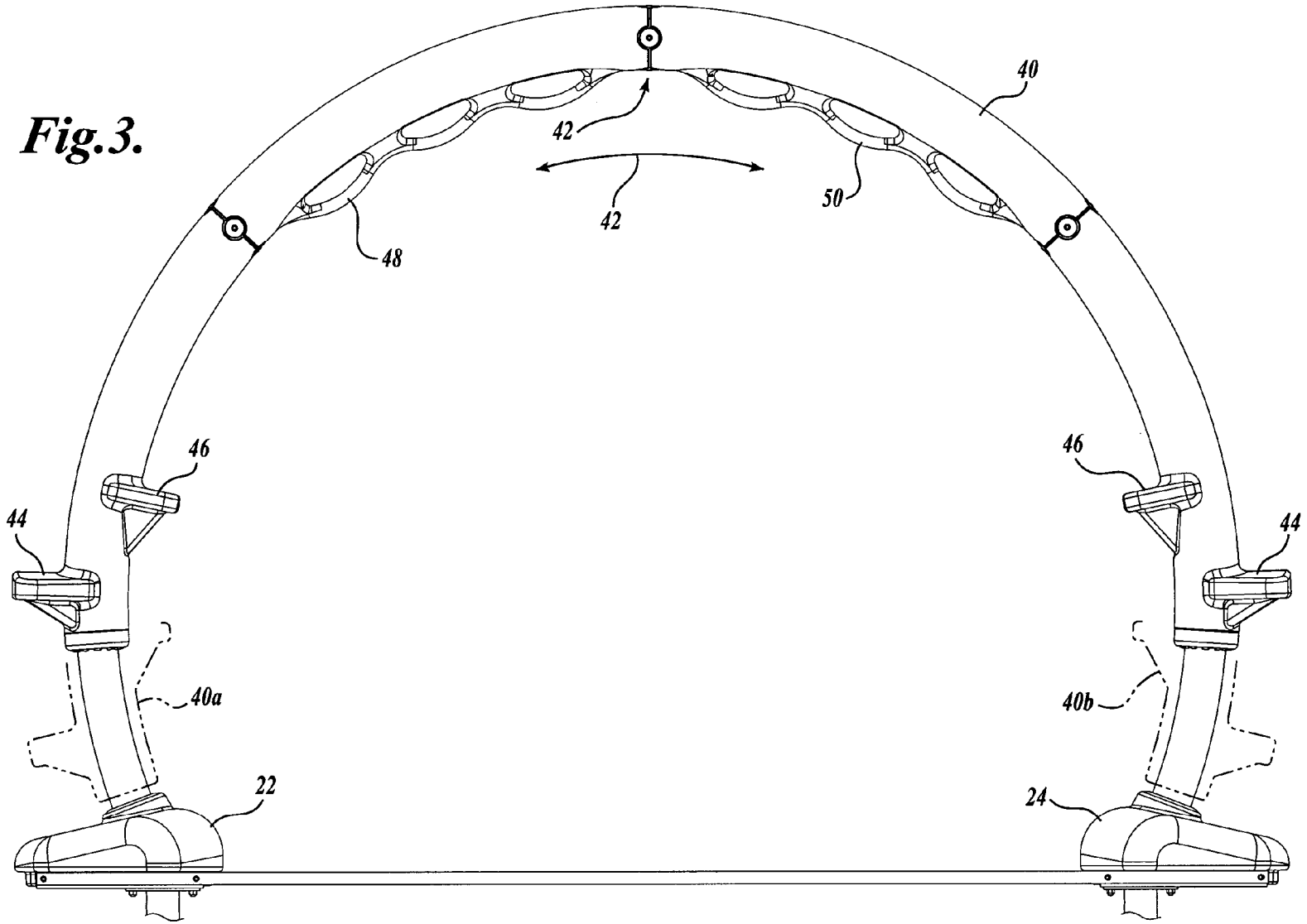
FIG. 3 is a side elevation view of the playground device.

Referring to FIGS. 1, 2, and 3, the playground device 20 of the present invention comprises a pair of base members 22 and 24. The base members are held in a horizontally spaced location by a pair of temporary spreader bars 26 and 28, the ends of which are respectively temporarily affixed to opposite base members 22 and 24. The spreader bars 26 and 28 stabilize the horizontal position of the base members during installation. Each of the base members 22 and 24 carries an anchor 30 and 32, respectively. The anchors 30 and 32 are affixed to the bottom portion of the base members by any conventional fastening means. When installed, the base members lie on the surface of the playground on which the device is installed. The anchors are normally embedded in a concrete footing.

A pair of support arms 36 and 38 are respectively mounted on the base members 22 and 24. The support arms 36 and 38 extend upwardly and arcuately. As will be explained in more detail later, a rail, which preferably comprises a segment of a circle, is attached to the upper end of the arms 36 and 38. The rail carries a hollow tube member 40, which is positioned for to-and-fro movement relative to the rail and the support arms 36 and 38. This to-and-fro movement is signified by the arrow 42 in the figures. As shown in FIG. 3, the hollow tube 40 can move in a leftward and downward arc to a position 40*a* shown in dotted outline adjacent base member 22 and can move in a rightward and downward direction to a position 40*b* shown in dotted outline adjacent base member 24. The hollow tube 40 is biased toward a center position indicated by arrow 42 by a biasing mechanism described in more detail below.

Still referring to FIGS. 1–3, user seats 44 are mounted on the outer portion of the hollow tube 40 adjacent each of the ends. Second user seats 46 are mounted on the inner portion of the hollow tube 40 above the location of seats 44. In addition, handrails 48 and 50 are mounted on each side of the center position of the tube 40. Children can thus seat themselves on seats 44 and push off the base members with their feet to enjoy an up and down riding motion on the arcuate tube providing a sensation similar to that of a conventional teeter-totter. The playground device of the present invention, however, does not exhibit any of the negative aspects of the teeter-totter in that this device is biased to a center position. Thus, if one of the children should, for example, exit seat 44, the device will not suddenly move in the opposite direction, but instead will be restrained by the biasing mechanism and by a second stop mechanism described in more detail below. Similarly, the handrails can be grasped by children using the device to rock it back and forth as intended.

Figure 4:
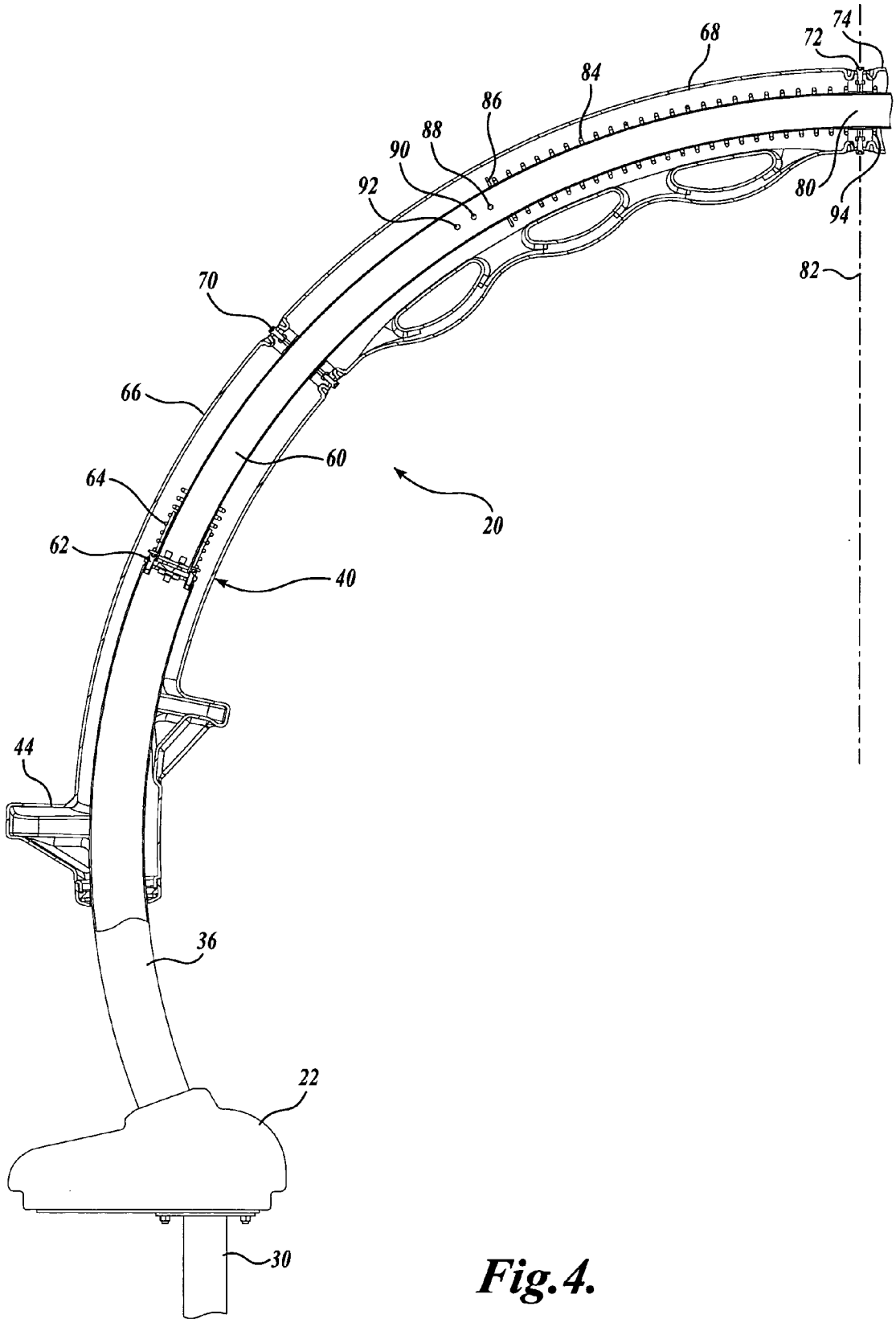
FIG. 4 is an enlarged side elevation view of the left portion of the device in partial cross section showing the hollow tube biased toward the predetermined position.

Referring now to FIG. 4, an enlarged view of the left half of the playground device 20 is illustrated in partial cross section. The left base member 22 is shown with only a portion of the anchor 30 extending below it. The support arm 36 extends upwardly from the base member in a circular arc. The right half of the device is the mirror image of the left half shown in FIG. 4. About 20°–30° above the base member 22, the rail 60 is attached to the upper terminus of the support arm 36. This attachment is via conventional means. The rail 60 has a diameter less than that of the support arm 36, forming a shoulder 62 on the upper edge of the support arm 36. A coil stop spring 64 surrounding the rail has its lower end positioned against the shoulder 62. The function of the stop spring will be described in more detail below.

The left half of the hollow tube 40 comprises two segments 66 and 68. The two segments 66 and 68 are joined by a truck mechanism 70, described in more detail below. The truck mechanism secures the segments 66 and 68 together and also carries a set of wheels that ride on the rail so as to allow relatively frictionless, reciprocating movement of the truck and thus, the tubular member 40 relative to the rail 60. The upper end of the second segment 68 of the tubular member is joined by another truck 72 to the upper segment 74 of the right half of the tubular member 40.

The uppermost (preferably central) portion 80 of the rail 60 is shown bisected by a vertical plane 82. The vertical plane 82 bisects the playground device into its left and right halves. The tubular member is urged or biased to this position by a biasing mechanism that includes a coil spring 84 that abuts the left side of central truck 72 and abuts a stop washer 86, positioned on the rail outwardly from the plane 82. The stop washer is fixed at its location to the rail 60 via a stop pin 88. The stop pin 88 is inserted through a diametric bore in the rail 60. Additional bores 90 and 92 are provided so that the position of the washer 86 can be adjusted further away from the vertical plane 82 to accommodate different length springs and/or to accommodate pre-tensioning of the spring 84. A similar biasing spring 94 is positioned in the right half of the playground device in mirror image to the springs described in this figure.

Figure 5:
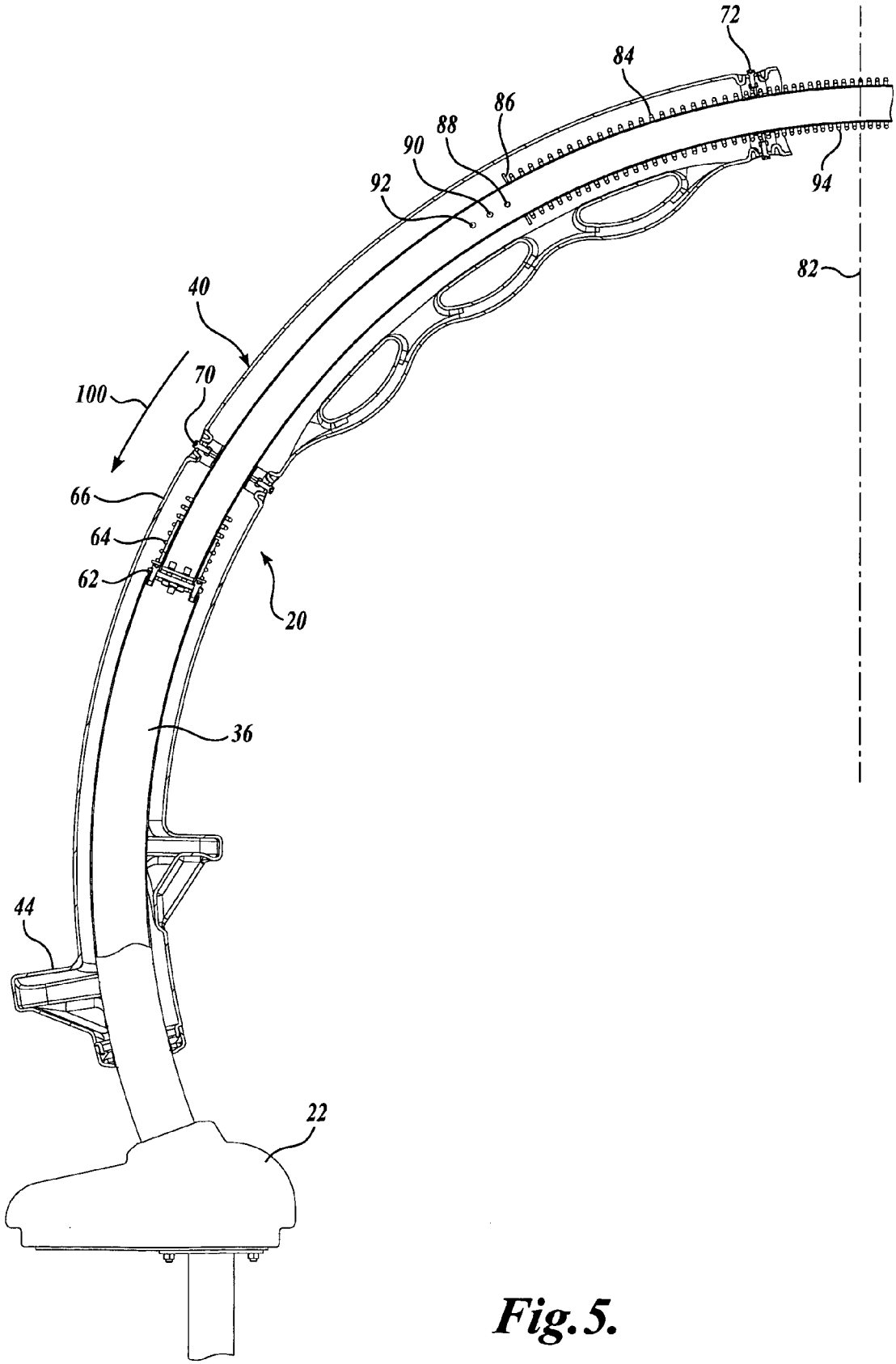
FIG. 5 is a view similar to FIG. 4, showing the hollow tube being urged in one direction against the biasing means.

As shown in FIG. 4, the tubular member 40 is shown at its at rest position biased so that the central portion of the tube and central truck 72 lie along the vertical plane 82. Referring now to FIG. 5, the tubular member 40 is shown urged in a leftward and downward direction indicated by arrow 100. As this occurs, the center truck 72 moves away from the vertical plane 82 and compresses the spring 84 against the stop washer 86. The force to move the tubular member 40 in the direction of arrow 100 is provided by the co-action of either one person sitting on the seat 44, for example, or by persons sitting on both seats 44 on the left and right-hand sides of the device, with the person on the right-hand side providing an upward thrust, for example, with his legs against the right-hand base member 24. This allows the tubular member to compress the biasing spring 84. As it is compressed, it slows and stops the leftward movement of the tubular member 40. The spring 84 then releases its energy and moves the tubular member 40 back to its centered position. If, for example, the user in the left-hand seat 44 thrusts downwardly with his legs, the tubular member will pass the center point and compress biasing spring 94 on the right-hand side of the device 20. As noted above, the right-hand side of the device functions in mirror image to the left-hand side shown in FIGS. 4, 5, and 6. Thus, the centering/biasing spring 94 and a stop spring on the right-hand mirror image half of the device work in mirror image to the springs on the left side of the device as well.

Figure 6:
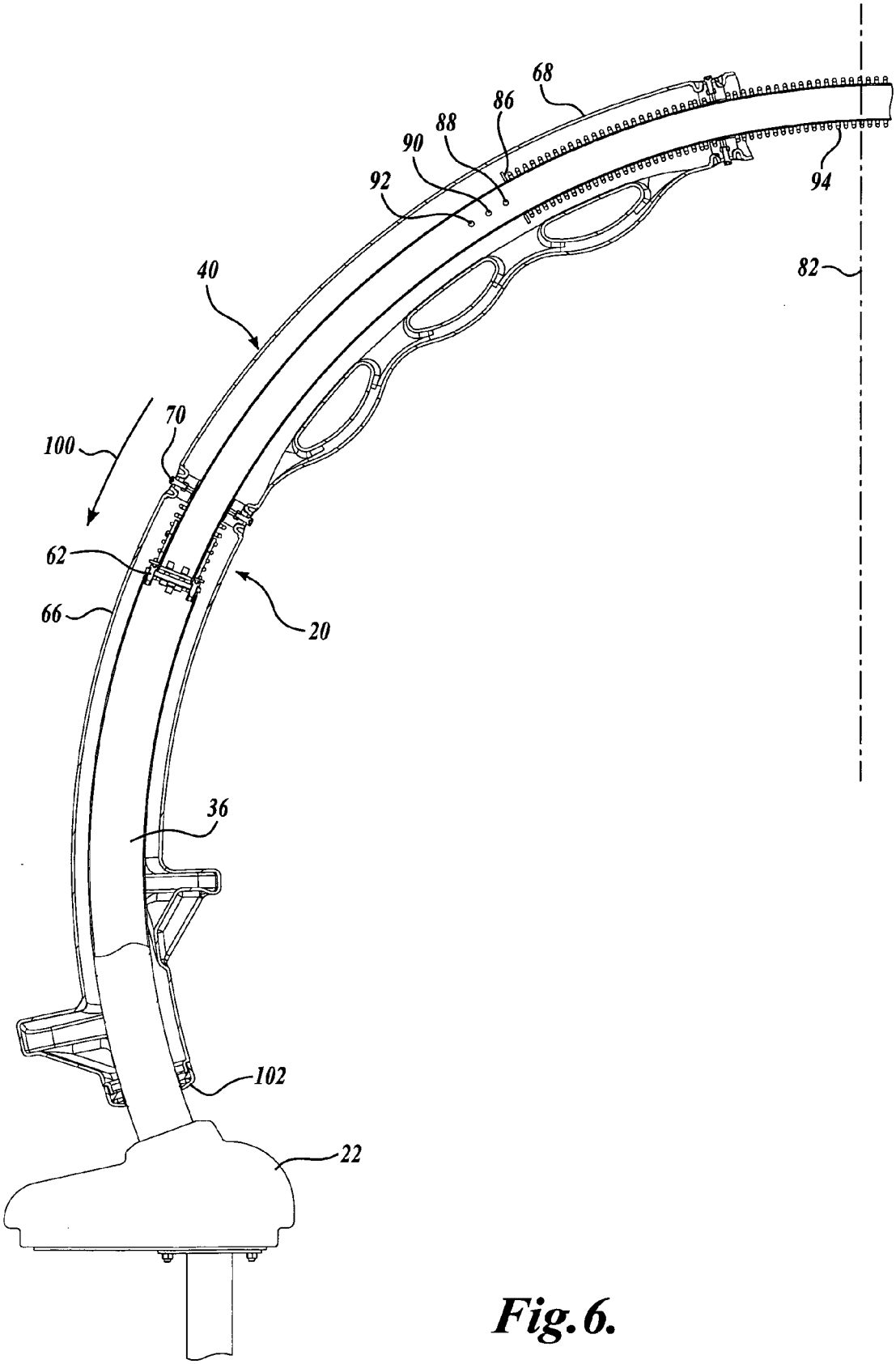
FIG. 6 is a view similar to FIG. 5, showing the hollow tube being further biased toward a position and urged against a stop mechanism.

If, for example, a person sitting on the right-hand seat 44 suddenly exits the device leaving a person on the left-hand seat 44, the tubular member would move to the left as shown in FIG. 5. The tubular member would tend to continue in the direction of arrow 100 because a person remains on the left-hand seat. As that occurs, the tubular member would move further downwardly, as shown in FIG. 6, at which point the truck 70, joining segments 66 and 68, would engage the stop spring 64 seated against the shoulder 62 on the support arm 36. The spring 64 has a spring constant that will bring the tubular member to a rest before the bottom end 102 of segment 66 contacts the base member 22. Further safety is designed into the device in that the bottom end 102 of the device 20 of the segment 66 is designed so that the space between the bottom end 102 and the base 22 is greater than any body part of the typical child using the device, thus preventing any compression injuries between the bottom end 102 and the base 22.

The biasing mechanism and the stop springs have been described in terms of mechanical coil springs. However, any physical device that is capable of performing the same function may be used. For example, elastic bands or compression devices may be substituted for the biasing springs and stop springs. Other equivalent devices, such as gas charged cylinders, may also be used.

Figure 7:
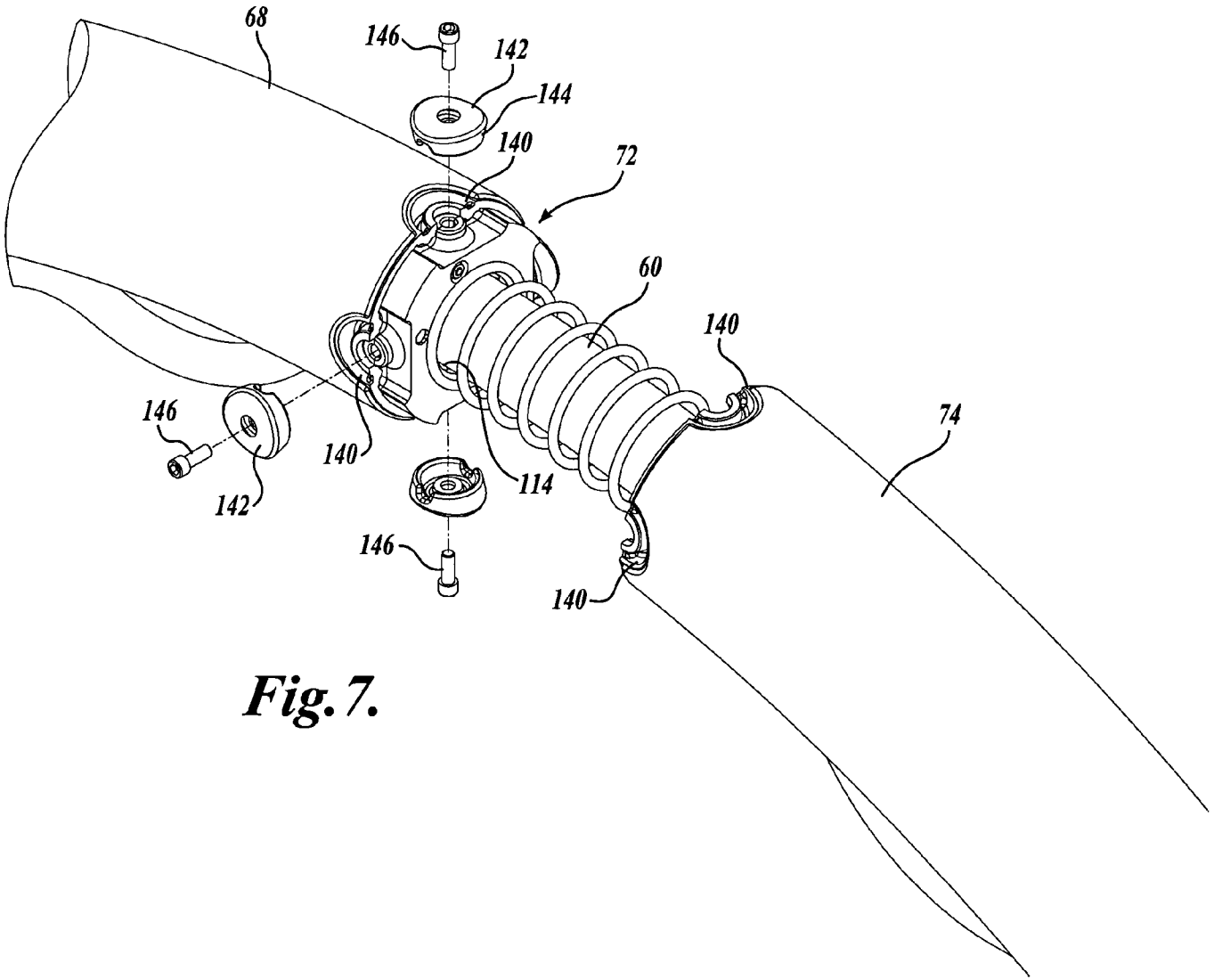
FIG. 7 is an exploded isometric view of the truck mechanism affixed to the hollow tube that rides on the rail.

Turning now to FIG. 7, the central truck 72 joining tube segments 68 and 74 is illustrated. The tube segment 74 is shown in an unassembled condition slightly spaced from the truck 72. The truck 72 serves the dual purpose of affixing the ends of tube segments 68 and 74 together and provides support for a plurality of wheels that ride on the center rail.

Figure 8:
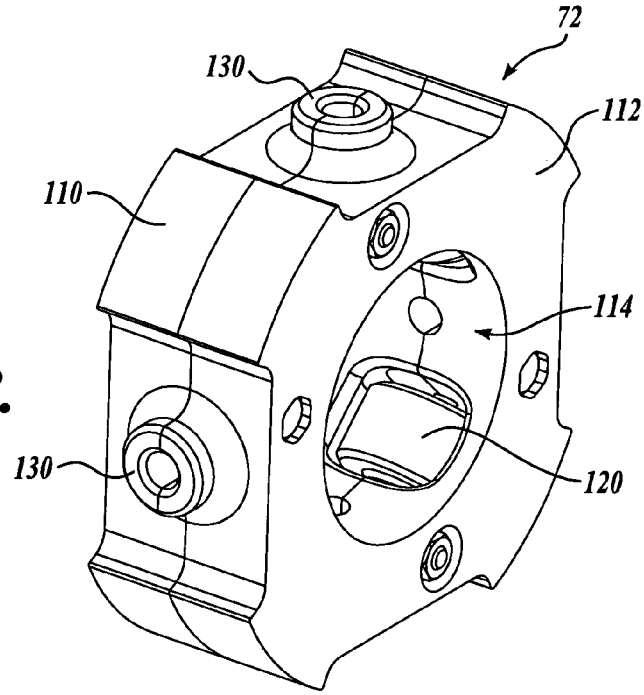
FIG. 8 is an enlarged isometric view of the truck mechanism.
Figure 9:
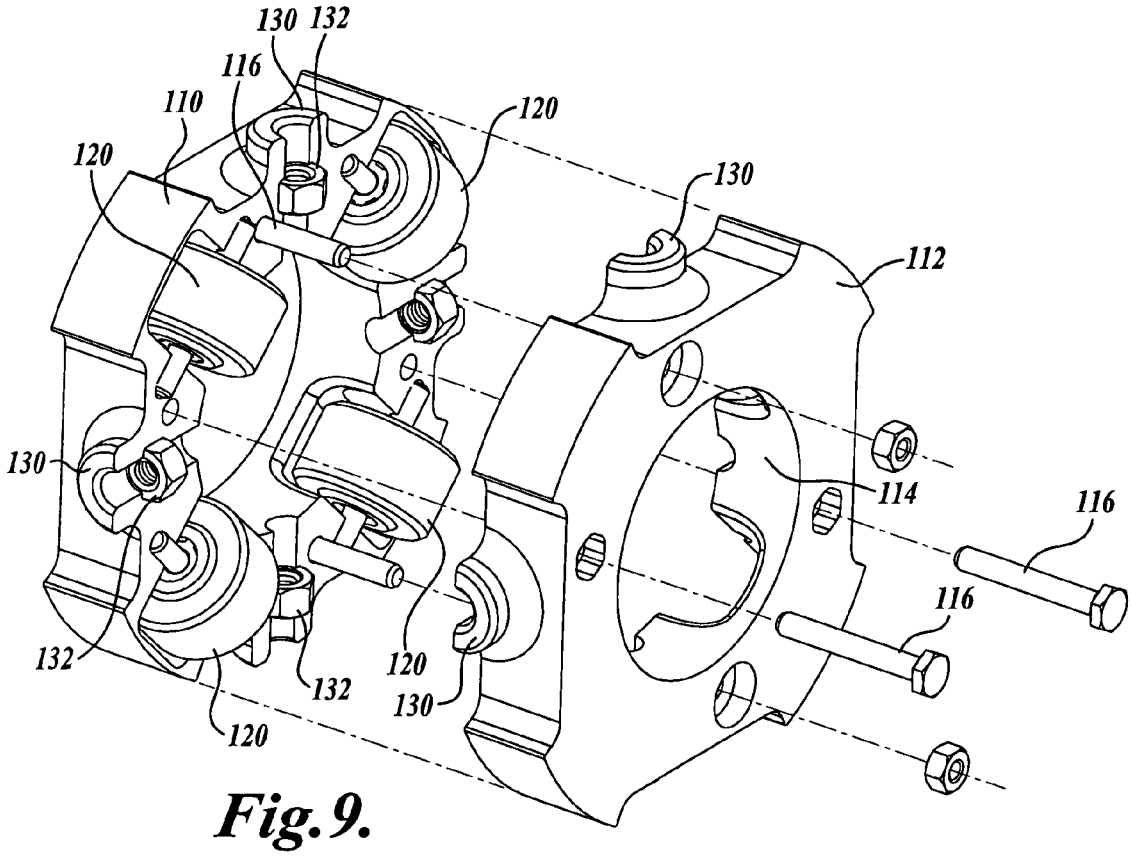
FIG. 9 is an exploded isometric view of the truck mechanism.

Referring to FIGS. 7, 8, and 9, the generally annular body of the truck 72 has left and right halves 110 and 112. A central opening or bore 114 is provided through which the rail 60 extends. The two halves 110 and 112 are held together by conventional fasteners 116 extending through bores that are parallel but spaced outwardly from the central bore 114. Preferably, four fasteners 116 spaced at 90° locations about the central bore 114 are provided. The interior of the halves 110 and 112 are provided with recesses that carry four wheels 120 spaced at 90° locations in the interior of the truck. The axles are positioned in mating recesses in the halves 110 and 112 so that when the halves are joined, the axles are fixed in place. The axles are oriented so that the wheels rotate in a plane oriented in the longitudinal direction of the rail. The wheels are positioned such that they extend slightly into the bore 114. Opposing wheels are spaced at a distance approximately equal or slightly larger than the diameter of the rail 60 so that the wheels will rotate on the side of the rail and the trucks will smoothly carry the tube in a to-and-fro motion along the rail.

The truck 72 also carries four projections 130 that extend radially outwardly from the outer annular surface of the truck 72. The projections are also annular in configuration with one-half of each annulus residing on truck half 110 and the other half residing on truck half 112. When the truck halves 110 and 112 are joined together, the annular projections are completed and extend outwardly from the truck 72. Positioned in a cavity within the truck halves 110 and 112, below the central bore of the annular projections 130, are nuts 132. The nuts are aligned with the axis of the bores of the annular projections 130.

Referring back to FIG. 7, the ends of the tubular segments 68 and 74, when joined together, have annular depressions 140, half of which are formed on opposing segment ends of tubes 68 and 74. The annular depressions are spaced circumferentially at 90° from each on the tubes 68 and 70. When the tubes are abutted, an annular depression is formed with a central opening. The central opening is sized to fit around and receive the annular projections 130 on the truck. To join the segments together and fasten them to the trucks, grommets 142 having a downwardly extending lip 144 are sized to fit into the depressions 140. As shown, four annular depressions 140 are positioned around the tube segments 68 and 74. The grommets 142 are inserted into the annular depressions 140 and fasteners 146 are inserted through the bore in the center of the grommets 142. These fasteners 146 are threaded into the nuts 132 embedded in the truck to thus securely fasten the grommet 142 in the annular depression 140, thus performing the dual function of securing the segments 68 and 74 to the truck 72 and securing the segments 68 and 74 to each other.

While the preferred embodiment of the invention has been illustrated and described, it will be appreciated that various changes can be made therein without departing from the spirit and scope of the invention.

The invention claimed is:

1. Playground device comprising:

first and second spaced base members;

an arcuate rail coupled to the base members;

an arcuate member surrounding at least a portion of the rail;

the arcuate member mounted for to-and-fro movement relative to the arcuate rail;

user platforms mounted at each end of the arcuate member; and biasing means coacting between the arcuate member and the rail to bias the arcuate member toward a predetermined position on the rail, and to allow the arcuate tube to move to-and-fro on the rail.

2. The device of claim 1, wherein said arcuate member is a hollow tube surrounding said rail, and wherein said arcuate rail and said tube are segments of a circle, said rail being mounted upright so as to extend first in an upward extending arc, and then in a downward extending arc, said rail having an uppermost position, said predetermined position being located at or adjacent said uppermost position.

3. The device of claim 2, further comprising:

first and secondary arcuate support arms extending respectively upwardly from said first and second bases, said rail being connected at its respective ends to respective ones of said support arms.

4. The device of claim 2, further comprising:

a plurality of support trucks mounted on said tube at spaced locations thereon, said support trucks movably mounted relative to said rail.

5. The device of claim 4, wherein said support trucks include a frame surrounding said rail, and a plurality of wheels mounted for rotation on said frames, said wheels riding on said rail to space the frame and thus the tube from the rail.

6. The device of claim 5, wherein said trucks each have four wheels mounted about 90 degrees from each other about said rail.

7. The device of claim 4, wherein one of said trucks is mounted in the middle of said arcuate tube, said biasing means biasing said truck toward the predetermined position on said rail.

8. The device of claim 6, wherein said biasing means comprises first and second elastic members positioned on opposite sides of said one truck, said elastic members coacting between the rail and the truck to bias the tube to a central position.

9. The device of claim 8, wherein said elastic members comprise coil springs surrounding said rails, one end of each of said springs contacting opposite sides of said one truck, the other ends of said springs contacting stop members affixed to the rail on opposite sides of said central position, whereby one spring is compressed when the tube is moved in a first direction from said center position, and the other spring is compressed when the tube is moved in an opposite direction from said center position.

* * * * *

UNITED STATES PATENT AND TRADEMARK OFFICE

CERTIFICATE OF CORRECTION

PATENT NO. : 7,118,514 B2
APPLICATION NO. : 10/980774
DATED : October 10, 2006
INVENTOR(S) : J. Underbrink et al.

It is certified that error appears in the above-identified patent and that said Letters Patent is hereby corrected as shown below:

| COLUMN | LINE | ERROR |
|---|---|---|
| 5 (Claim 1, | 19 line 12) | "arcuate tube" should read --arcuate member-- |

Signed and Sealed this

Sixth Day of March, 2007

JON W. DUDAS
*Director of the United States Patent and Trademark Office*